United States Patent [19]

Tauzin

[11] 3,931,769

[45] Jan. 13, 1976

[54] AUTOMATIC OPENING AND CLOSING CABIN FOR ROPEWAYS

[75] Inventor: Francis Tauzin, Veyrins, France

[73] Assignees: Pomagalski S.A., Grenoble; Sigma Plastique, Veyrins, both of France

[22] Filed: Aug. 2, 1974

[21] Appl. No.: 494,181

[30] Foreign Application Priority Data

Aug. 7, 1973 France ..... 73.28795

[52] U.S. Cl. ..... 105/329 S; 105/343; 105/345

[51] Int. Cl.[2] ..... B60N 1/04

[58] Field of Search ..... 105/150–153, 105/329 S, 339, 397, 343, 345, 329 SC; 104/173 R, 173

[56] References Cited

UNITED STATES PATENTS

| | | | |
|---|---|---|---|
| 2,949,864 | 8/1960 | Rubin | 105/150 |
| 3,094,079 | 6/1963 | Greil | 105/329 S |
| 3,353,503 | 11/1967 | Pettit | 105/329 S |
| 3,556,016 | 1/1971 | Ponagalski et al. | 105/329 S |
| 3,606,843 | 9/1971 | Adams et al. | 105/397 |

*Primary Examiner*—John J. Love
*Attorney, Agent, or Firm*—Ulle C. Linton

[57] ABSTRACT

This cabin gondola or car for ropeway, intended for transporting passengers between two stations on a rope driving a plurality of disconnectable cabins or cars, has an automatic door opening and closing mechanism and the two doors are slidably mounted on the same side of the two-shell cabin housing for closing corresponding apertures somewhat spaced so as to leave a solid wall section therebetween, the mechanism actuating said doors causing same to be superposed to each other against said solid wall portion, a pair of bench-forming seats being disposed transversely and back-to-back, very close to each other, in the tranverse space extending normally to said solid wall portion.

7 Claims, 6 Drawing Figures

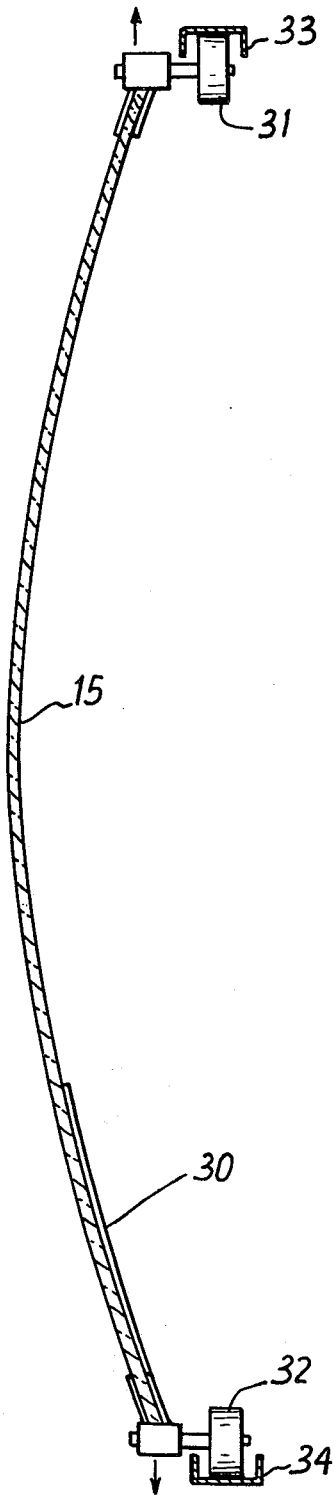
Fig. 4
Fig. 6
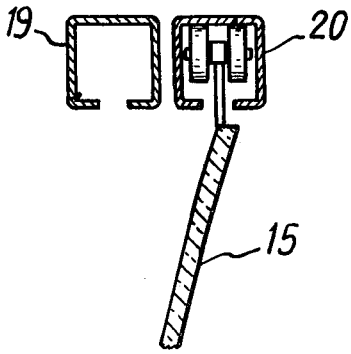

AUTOMATIC OPENING AND CLOSING CABIN FOR ROPEWAYS

BACKGROUND OF THE INVENTION

1. Field of the Invention

The present invention relates to rodeways of the type designed for transporting passengers between two stations by means of a cable or rope driving a plurality of cabins, cars or gondolas adapted to be disconnected by clutch means from the cable at said stations and to transport only a few persons. More particularly, this invention relates to a cabin of this general character, which is provided with means for automatically opening and closing the doors thereof.

2. Description of the Prior Art

In a prior U.S. Pat. No. 3,556,016 in the name of the same Applicants, it has already been proposed to construct the housing or envelope of the cabin in the form of a shell actually consisting of a pair of moulded plastic shells assembled along a vertical transverse joint or median plane, these shells being pivoted to each other on one side about a vertical axis so as to open along the joint plane on the opposite side so as to clear a lateral passage centrally of this last-mentioned cabin side.

In a cabin of this type with the exit and access located in the middle of one side, the seats supported by the carrier frame structure are disposed transversely, in face-to-face relationship, on either side of the vertical transverse plane of symmetry of the cabin, so that the passengers are supported near the two ends of the cabin, in the front and rear portions thereof, and face each other, therefore without having a complete forward or rearward visibility.

The passenger capacity of the ropeway is obviously limited by the number of cabins, the capacity of each of them, i.e. their number of seats, and also by the stopping time required at both stations for the disconnected cabins for enabling the passengers to step in and out. In many cases, it would be desirable to reduce stopping times by accelerating the stepping in and out of the passengers. It may also be desirable to increase the number of seats per cabin and this increased number of seats requires an easier and more rapid ingress and egress of the passengers.

SUMMARY OF THE INVENTION

It is therefore the essential object of this invention to permit considerably faster passenger ingress and egress through a novel arrangement of the automatic opening and closing cabin, which is also characterised by complementary features and advantages to be set forth more in detail presently.

According to this invention, the shell constituting the cabin housing also comprises two half-shells (to be designated hereinafter by the term "shells") assembled in a vertical transverse median plane but remaining constantly fixed in relation to each other. This cabin is further characterised by the presence of two lateral apertures disposed on the same side of the cabin, on either side of said joint plane, and having a relative spacing such that sliding doors associated with these two apertures can be opened by moving same to a position in which they register with each other against the inner side of the solid wall portion extending between the aforesaid apertures.

Within the cabin, two bench-like seats are disposed transversely and in back-to-back relationship on either side of the aforesaid joint plane and in close vicinity of each other with this arrangement, a relatively wide windshield consisting of a curved transparent sheet can be provided in front of each seat, thus offering to the passengers an ample, free panoramic view in the direction of travel of the cable railway, forwards for the passengers of the front seat and backwards for the passengers of the rear seat.

From the foregoing it is obvious that the two exit and access apertures across the lower limbs of the passengers sitting in the cabin permit an easier and faster passenger ingress and egress; futhermore, with this arrangement it is possible, without unduly increasing the cabin stopping time at the stations, to use cabins having a greater passenger capacity, i.e. a greater number of seats, if desired, for instance six-seater cabins comprising each two three-seat benches or seats. The cable railway cabin structure contemplated herein is also advantageous in that the loads are located very close to the actual center of gravity of the assembly, since the seats are disposed back-to-back and very close to each other, and the fact that loads are positioned near the center of gravity, in combination with the compactness and streamlined shape of the cabin, constitutes an additional safety factor in that it reduces pendular oscillations due to the wind pressure.

The door opening and closing movements are advantageously controlled automatically by a same cabin mechanism adapted to be actuated by opening and closing ramps provided at the end stations. Since the movements of the two doors, both in the opening and closing directions, take place in opposite directions, these movements of the pair of doors are similar to those of the opening edges of the pair of shells described in the above-mentioned U.S. Pat. No. 3,556,016, except that in the present invention the doors are moved towards each other for opening and away from each other for closing, in contrast to the opening shells of U.S. Pat. No. 3,556,016 (the shells moving away from each other for opening, and toward each other for closing). The similitude of these movements thus permits of utilizing a control mechanism operating on the same principle and having a substantially similar structure as those described in said U.S. Pat. No. 3,556,016. This mechanism comprises spring means providing the same action as described in said Patent. The control mechanism is adapted to lock the doors in the closed position and means may be provided for releasing this door locking mechanism from the inside of the cabin in case of emergency. This control mechanism is advantageously so constructed that the locking thereof in the closed position cannot prevent a partial manual opening of the doors for ventilating the interior.

A complementary and important feature characterising this invention lies in the fact that the two sliding doors are guided along their upper edge end along their lower edge by guideways engaged by rollers carried by said doors, and that these doors have from top to bottom a curved contour of which the inherent resiliency tending to approach a rectilinear contour causes the aforesaid rollers to be urged against the bottom of their guideways, thus centering said rollers automatically in said guideways and preventing the jamming thereof.

Another important complementary feature of the invention lies in the fact that the solid wall portion extending between the two access apertures is provided externally at its base with a ski-holder or ski-buckets of same width, adapted to carry in a vertical position a number of pairs of skis equal to the number of passengers that can be accomodated in the cabin.

In order to afford a clearer understanding of this invention a typical form of embodiment thereof will now be described in detail with reference to the attached drawings.

DESCRIPTION OF THE DRAWINGS

FIG. 4 is a vertical section showing a sliding door;

FIG. 6 is a vertical cross-section showing two juxtaposed guideways for the pair of sliding doors.

DESCRIPTION OF THE PREFERRED EMBODIMENT

Figure 1:
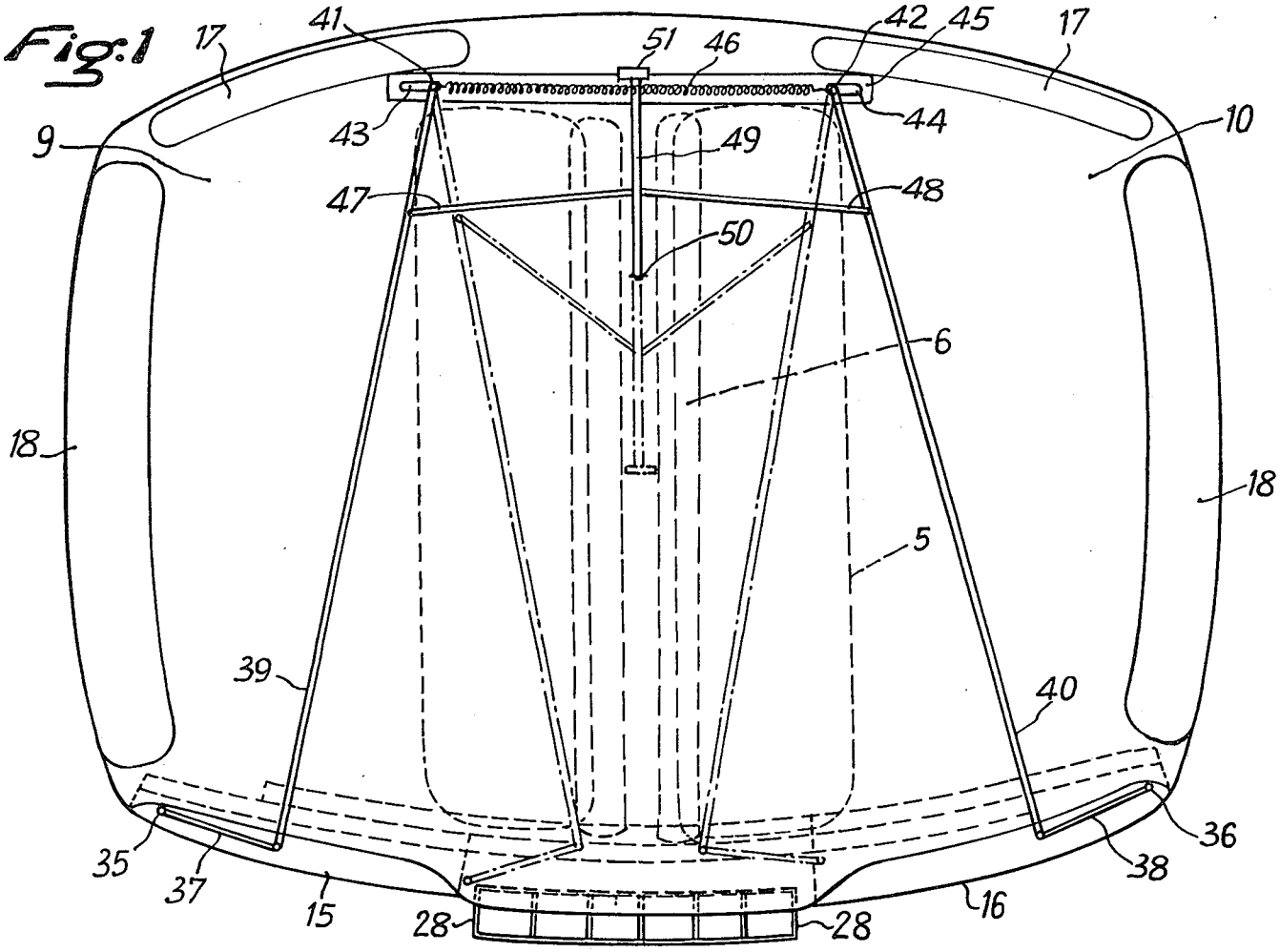
FIG. 1 is a diagrammatic plane view from above of the cabin with its automatic door control mechanism.
Figure 2:
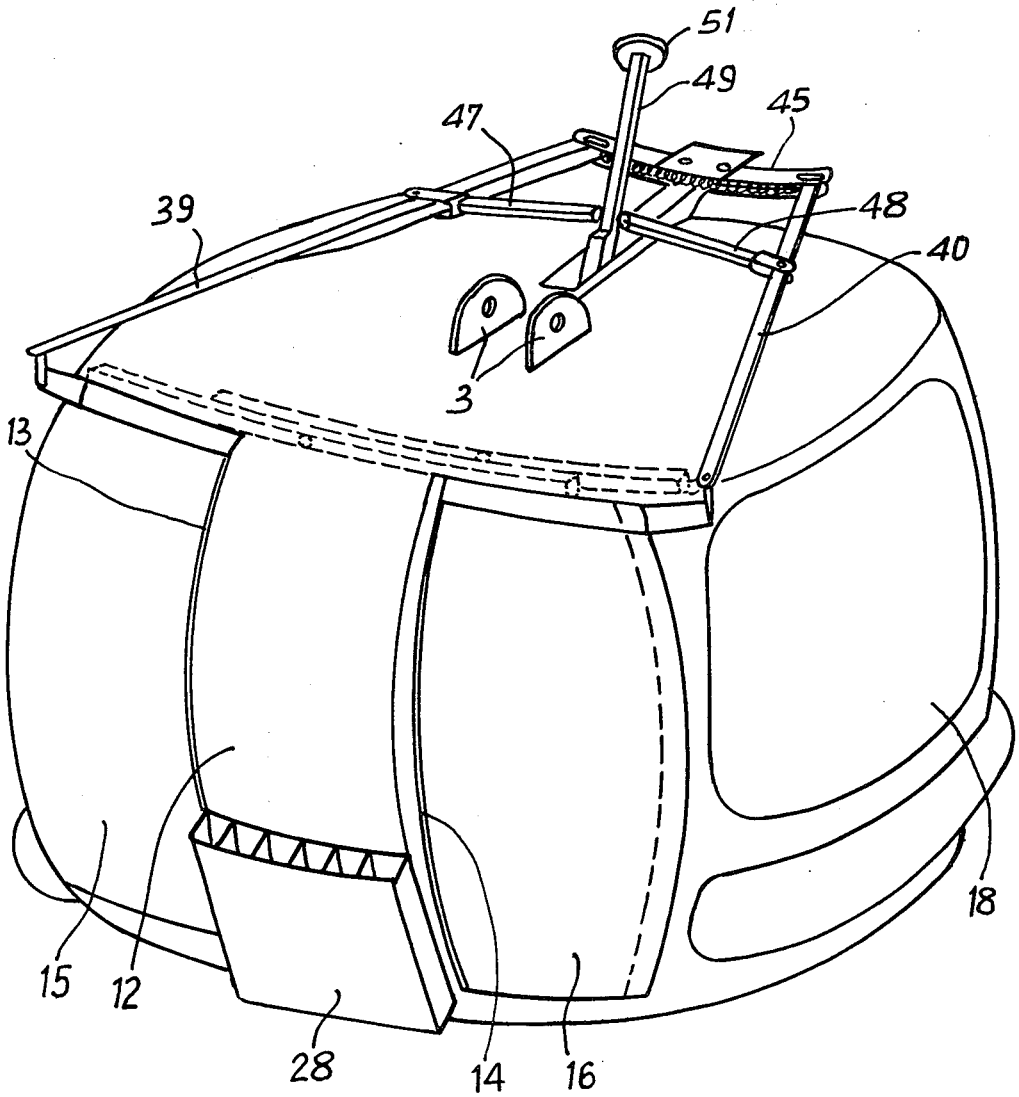
FIG. 2 is a corresponding perspective view of the cabin as seen from the side provided with the sliding doors.
Figure 3:
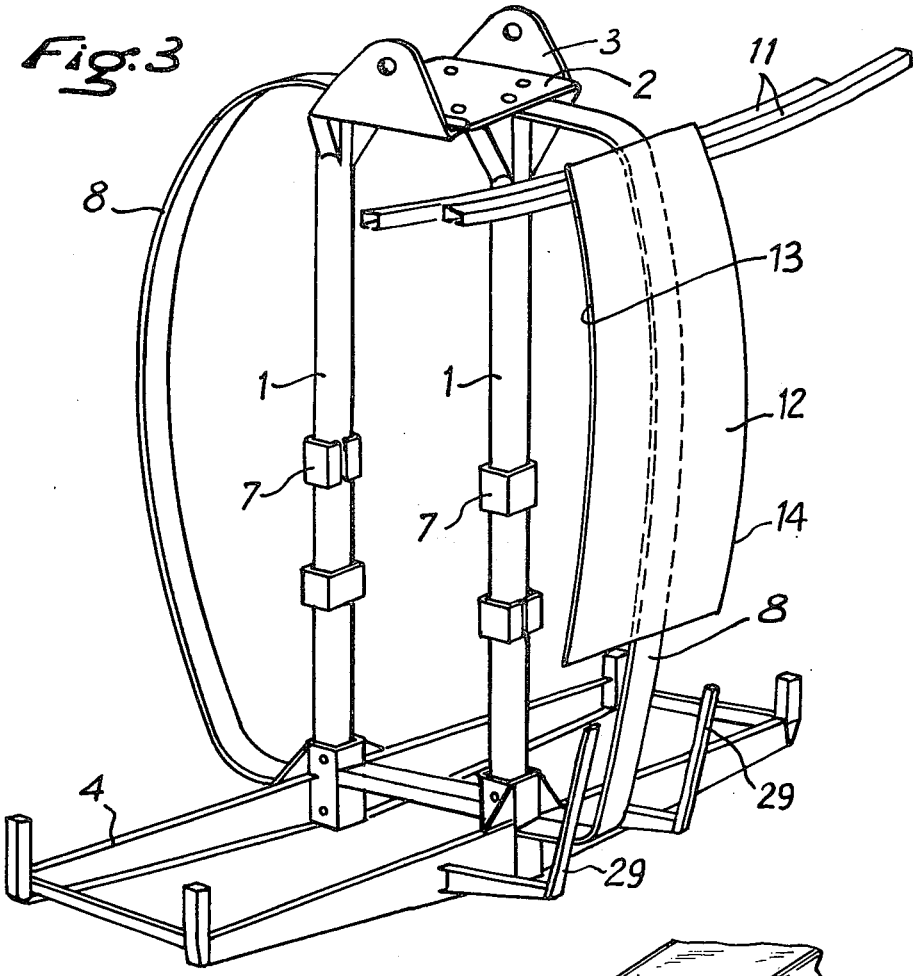
FIG. 3 is a perspective view of the frame structure supporting the cabin.

In the exemplary form of embodiment illustrated in FIGS. 1 to 3 of the drawings, the carrier frame structure of the cabin according to this invention comprises essentially a pair of vertical metal uprights or columns 1 rigid with an upper cross member 2 adapted to be suspended externally of said cabin from the suspension carrier of any suitable and known type by means of a strap 3. These uprights 1 are spaced from each other in the vertical median transverse plane of the cabin and carry at their bottom brackets 4 extending from, and on either side of, said transverse plane, for supporting the floor of the cabin. The carrier frame structure also supports the metal frames of a pair of seats 5 (FIG. 1) disposed back to back, the back-rests 6 thereof being carried by clamps 7 secured to the uprights 1 of the frame structure which are thus braced by said back-rests 6. The carrier frame structure further comprises a pair of metal bows 8 disposed in said median vertical transverse plane and constituting together a ring-like structure receiving on either side the external shells 9 and 10 of the cabin. Preferably, these shells 9 and 10 consist of a suitable rigid plastic material. The carrier frame structure also supports at its upper and lower portions the rail means for guiding the sliding doors, as shown generally by the reference numeral 11 in FIG. 3 in the case of the upper rails.

On the cabin side in which the lateral aperture are formed the shells 9, 10 are provided with a solid outer wall portion 12 disposed on either side of said vertical joint plane of the two shells, and this solid wall portion 12 consiting of two sections each pertaining to one shell has a width approximating that of the aforesaid lareral apertures 13 and 14 formed on the same side of the cabin in said shells, on either side of said solid wall portion 12. The aperture 13, 14 are adapted to be closed by sliding doors 15, 16 having an adequate curvature, notably in the vertical direction, to provide the desired contour in the closed position. These doors 15, 16 are guided along their upper and lower edges so as to uncover the corresponding apertures by sliding toward each other, that is, in opposite directions, against the inner face of the solid wall 12 having a curved shape matching that of said doors. An internal partition substantially parallel to said wall portion 12 and disposed at a relatively short spacing therefrom is adapted to constitute a double wall providing, between said partition and the wall portion 12, a recess adapted to receive the sliding doors 15, 16 in their open position, i.e. when these doors register or are coincident with each other. Each door may consist of tranparent or translucent plastic material such as P.V.C., preferably with a metal lining in their lower portions to protect them against shocks and kicks. The opposite side of the cabin may advantageously comprise similar transparent areas 17 to provide an adequate lateral visibility. Moreover, the cabin comprises at its front and rear upper portions two relatively wide windshields 18 consisting of transparent sheets registering and facing with each seat 5, thus offering to the passengers a free panoramic view toward both the front rear of the vehicle.

Figure 5:
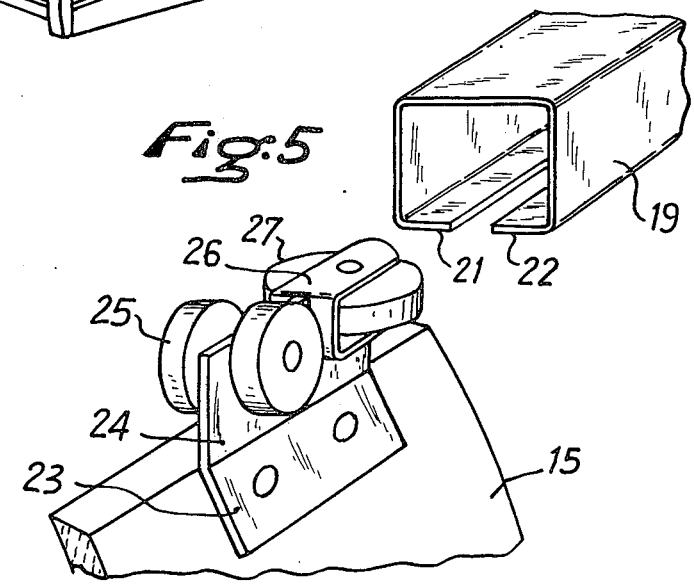
FIG. 5 is a perspective view showing more in detail the means for suspending and guiding a sliding door.

Each door 15, 16 carries on its upper and lower edges a set of supporting and guiding rollers adapted to travel for each edge along a pair of fixed rails of arcuate contour as shown at 19, 20 in FIG. 6 for the upper rails rigid with the carrier frame structure and each provided for one of the two doors. Each one of these two rails consists for example of a box-sectioned metal member having formed in its base side a median longitudinal slot between a pair of side wings 21, 22 (FIG. 5) permitting the passage of the guiding means for the corresponding door. Each guide means may comprise a metal plate 23 secured to the upper edge of the door and formed with a vertical extension 24 carrying by means of a horizontal pin a pair of suspension rollers 25 on either side of the portion of plate 24 of which the base overlying the door travels in the slot formed between said wings 21 and 22. The aforesaid plate portion 24 may also carry a strap 26 in which a roller 27 having a vertical axis is rotatably mounted for guiding the door along one or the other vertical sides of rail 19 or 20.

Each door 15, 16 carries along its base another guide means exactly similar to that described hereinabove but inverted to guide the doors by sliding engagement in rails similar to the rails 19, 20 but disposed in opposition thereto beneath the floor level of the cabin.

At its base the solid wall 12 carries on its outer face a ski-holder or ski-buckets 28 which, as shown by way of example in the drawings, is adapted to hold six pairs of skis for a six-seater cabin, said ski-holder or ski-buckets 28 being carried by the brackets 29 carried in turn by the frame structure.

In order to ensure a reliable guiding of the sliding doors, that is, without any possibility of jamming or wedging same, the inherent resiliency of the vertically curved contour of said doors may be utilized as shown in FIG. 4, in the case of the door 15 of which the metal protection lining is designated by the reference numeral 30. In this example shown diagrammatically in FIG. 4 the door 5 manufactured from a substantially flat panel and provided along its upper and lower edges with roller means designated diagrammatically by the reference numerals 31 and 32 for guiding the door in rails 33 and 34, is cold-bent with a convexity directed externally of the cabin between the two guide rails, whereby the inherent resiliency of the door tends naturally to straighten the door and exerts on these means opposite vertical forces tending to press them against the bottom of the guideways 33 and 34 as shown by the arrows in FIG. 4. This resiliency may be utilized efficiently for centering the rollers in their guideways between the curved sections interconnecting the wings of the guideways while avoiding any jamming thereof. With this arrangement, the vertical axis rollers 27 of FIG. 5 may be dispensed with.

As already mentioned hereinabove the automatic door control mechanism of this invention is much similar to the mechanism described in the aforesaid U.S. Pat. 3,556,016 and consequently only a brief description thereof will be given herein with reference to the diagram of FIGS. 1 and 2. Ths opposite ends of the upper edges of the pair of doors 15, 16 carry a connecting pin 35, 36 pivoted to one end of a link 37, 38 extending substantially longitudinally, the other end of this link 37, 38 being pivotally connected to a control rod 39, 40. The opposite end of this control rod 39, 40 carries a stud 41, 42 engaging an elongated slot 43, 44 formed in a fixed, straight longitudinal section member 45 rigidly connected to the frame structure, said pair of studs 41, 42 being interconnected by a traction spring 46, as shown. The pair of links 37, 38 are connected through a pair of rods 47, 48 and ball-and-socket joints to a control lever 49 having a substantially vertical mean direction and pivoted to a fixed horizontal longitudinal shaft 50 so as to oscillate in a transverse plane in relation to the cabin. This lever 49 carries at its upper end a roller 51 adapted to be actuated by the automatic control ramps provided at the two terminal stations of the ropeway (not shown); in the closed position an effort exerted on the door in the opening direction tends to keep the lever 49 against a stop, thus providing the necessary locking action. It will be seen that the above-described mechanism utilizes component elements similar to those described in the above-mentioned U.S. Pat. No. 3,556,016. However, the specific arrangement described hereinabove should not be construed as limiting the scope of the present invention and it will readily occur to those conversant with the art that equivalent means could be contemplated for the pratical actuation of the invention without departing from the basic principles thereof.

In FIG. 1, there is shown in thick lines the automatic door control mechanism in its closed-door position, the dash-and-dot lines illustrating this mechanism in its open-door position. In FIG. 2, the dash-and-dot lines show in the case of the right-hand door 16 a partially open position obtained for ventilating purposes wherein, due to the loose connection via elongated hole 44 for said control rod 40 with fixed member 45, said control rod 40 can be moved slightly as permitted by the length of slot 44, against the force of return spring 46, without modifying the position of the pivot point of connecting rod 48, i.e. without moving the control lever 49 normally in abutment in its closed position. Thus, the door can be kept ajar, against the force of spring 46, by using a pivoted sash-bolt or the like provided on the inner surface of the door, along the door edge disposed adjacent the corresponding cabin end, whereby releasing this sashbolt or like member by pivoting same will free the control rod and permit a complete closing of said door. Ventilating the interior through a long and narrow vertical aperture is particularly efficient.

Finally, the means holding the door locked in its closed position may also be controlled in case of need from the inside by means of an emergency handle connected to the lower portion of control lever 49 above its pivotal mounting 50, as already described and illustrated in said U.S. Pat. No. 3,556,016.

Though a single form of embodiment of the invention has been described and illustrated herein, it will readily occur to those skilled in the art that various modifications and changes may be brought thereto without departing from the basic principles of the invention as set forth in the appended claims.

What is claimed is:

1. Cabin with automatic door opening and closing mechanism, for ropeways, comprising a carrier frame structure, a cabin housing supported by said carrier frame structure, said cabin housing comprising a pair of shells of plastic material and assembled together along a transverse vertical median joint plane, two lateral apertures provided on a same side of cabin housing, on either side of said joint plane and spaced the one from the other by a solid wall portion, a sliding door associated with each one of said two apertures, said sliding doors being adapted to pass from a closed position to an open position by moving towards each other against an inner face of said solid wall portion, and a pair of bench-forming seats disposed transversely and back to back, very close to each other, in a transverse space extending normally to said solid wall portion whereby transverse spaces extending normally to said apertures remain substantially unobstructed.

2. Cabin as claimed in claim 1, wherein each shell has a wide windshield registering with the seat disposed in the corresponding cabin half, which gives to passengers sitting on said seat a free panoramic view in the direction of travel of the cabin, both forward and rearward.

3. Cabin as claimed in claim 2, wherein said solid wall portion of said cabin housing disposed between said apertures carries at its base and on its outer side a ski-holder adapted to receive, in vertical position, a number of pairs of skis equal to the number of passenger seats in the cabin.

4. Cabin as claimed in claim 1, wherein said carrier frame structure comprises uprights, an upper suspension cross member rigid with said uprights and disposed between said two seats, in the amidship transverse plane of said cabin, said carrier frame structure supporting directly said seats, a floor supported by said carrier frame, suspension and guiding rails supported said carrier frame for said sliding doors and the pair of shells forming said cabin housing.

5. Cabin as claimed in claim 1, which includes means for automatically controlling the opening and closing movements of said doors, said means including a control lever adapted to be actuated by conventional door opening and closing ramps provided at terminal stations of the ropeway, and a pair of connecting rods connected to said control lever and with said doors and capable, in relation with suitable movements of said control lever, to move either towards each other for opening said sliding doors or away from each other to ensure the closing of said doors.

6. Cabin as claimed in claim 5, including a control rod pivotally connected to said control lever, said connecting rods associated with said sliding doors are each pivoted on the one hand to a bearing point and on the other hand to said control rod, a return traction spring connects said connecting rods, the pivotal connections at said bearing points includes elongated holes which permit a slight displacement of said bearing points whereby said doors can be kept ajar against the action of said return traction spring, for a dual purpose of protecting the passengers and of permitting a proper ventilation of the cabin space, even in the locked-door position.

7. Cabin as claimed in claim 6, including roller means on the upper and lower edges of each of said sliding doors, guideways connected to said carrier frame structure having said roller means therein, said sliding doors each being cold-bent from top to bottom from a plastic or compound, substantially flat initial panel, whereby the inherent resiliency of each said door has an elastic bending prestress constantly tending to press said roller means against the bottoms of the relevant one of said guideways while centering said rollers means automatically and permitting their rolling movements without any risk of jamming or wedging.

* * * * *